US005846114A

United States Patent [19]

Frandsen, II

[11] Patent Number: 5,846,114

[45] Date of Patent: Dec. 8, 1998

[54] LIGHT-WEIGHT RESILIENT BUILDING UNIT

[75] Inventor: Donald L.. Frandsen, II, Elkhart, Ind.

[73] Assignee: Foam Technology Inc., Elkhart, Ind.

[21] Appl. No.: 786,305

[22] Filed: Jan. 22, 1997

[51] Int. Cl.[6] ..... A63H 33/08

[52] U.S. Cl. ..... 446/106; 446/85; 446/369; 446/476

[58] Field of Search ..... 446/85, 106, 476, 446/369

[56] References Cited

U.S. PATENT DOCUMENTS 2,059,598 11/1936 Paulson ..... 446/85 X 2,274,303 2/1942 Ornstein ..... 446/369 X 3,518,786 7/1970 Holtvoigt ..... 446/85

5,067,925 11/1991 West ..... 446/369 X

*Primary Examiner*—Robert A. Hafer

*Assistant Examiner*—Jeffrey D. Carlson

*Attorney, Agent, or Firm*—Watson Cole Grindle Watson , P.L.L.C.

[57] ABSTRACT

A building unit for constructing a structure, the unit being in the shape of a generally cylindrical log formed by a light-weight, resilient core encased snugly in a fabric covering have the same shape as the core.

4 Claims, 2 Drawing Sheets

LIGHT-WEIGHT RESILIENT BUILDING UNIT

BACKGROUND OF THE INVENTION

I. Field of the Invention

The present invention relates generally to building units adapted to be assembled into structures, and more specifically, it relates to light-weight building units that are assembled into structures that can easily be disassembled and which may serve several functions, including a play structure for children.

II. Description of the Prior Art

For well more than half a century children have played with toy miniature structures, in particularly, with a building set known as Lincoln Logs whereby miniature, log-simulating units have been used to build toy houses, stockades, bird houses, and other small structures. Such building sets have served their function well, and provided many hours of pleasant and rewarding constructions for children. Since the small, simulated logs are held in position relative to each other by the coaction of grooves at the ends of each log, the structure built by the child can readily be assembled and disassembled without the use of adhesives. Thus, for example, in U.S. Pat. No. 1,936,571 such a simulated log structure is disclosed, specifically for building a toy house that may be used as a bird house.

Recognizing that there may be other structures that can be erected by children, more recent patents such as U.S. Pat. No. 5,145,440 are directed toward a toy house that can actually be occupied by a child. In this case the play structure is constructed of inflatable elements that are deflated when not in use and stored in such deflated condition in a relatively small space. It is also recognized that the same basic structure of the Lincoln Log play house may be used to construct a log cabin that may actually be used as such by adults. U.S. Pat. No. 3,257,762 is directed to such a structure. Several other patents disclose log cabin construction are recited in U.S. Pat. No. 5,145,440.

Yet while the art apparently recognizes that a simple construction such as that originally designed as a child's toy can have uses other than simply building a miniature log cabin, it has not recognized how, other than with actual logs or an inflatable device, such a relatively large, log-imitative structure can be built without having to employ heavy building materials. Since a larger log cabin may be constructed without permanent adhesive and is thereby subject to facile disassembly, an accident that may cause the structure to be unintentionally destroyed could cause considerable harm to occupants thereof. Obviously, a log cabin made of even light-weight logs that are not fixedly held together but can readily be dismantled will, if accidentally destructed, have the potential to cause severe injury to occupants of the cabin.

It is, therefore, a prime object of the present invention to supply a log-type, interconnecting building unit structure which, if subjected to unintentional forces, and concomitant collapse, will not cause undue harm to any occupants of the structure, be they children or adults. It is another object of my invention to provide a light-weight structure that is subject to ready assembly and use for many purposes, and that will remain in assembled form with or without the utilization of adhesives.

SUMMARY OF THE INVENTION

The present invention takes the form of building units for constructing a finished structure, be it a house, stockade, or other aggregate that may be formed from the equivalent of logs having notched ends. A building unit according to the present invention comprises a pre-shaped core formed from a lightweight, resilient foam subject to ready deformation. That core, in itself, is not of sufficient stability to constitute the unit per se. Therefore, an outer covering is provided to enclose the core, that covering being in the form of a fabric having substantially the same shape as the core and encasing it snugly. In this basic structure the core, as encased in the covering, now has sufficient structural integrity to make it useful as a unit from a plurality of which a desired structure may be formed.

With regard to the covering for the core, it is preferably formed from the synthetic plastic, such as a vinyl polymer. In order to permit insertion of the foam core within the covering, the covering has means formed therein to permit the insertion of the core, to retain the core after it has been located within the covering, and then to permit removal of the core, should it be desired to do so. In one embodiment the means in the covering through which the core may be inserted is a longitudinal slit extending a majority of the length of the covering. Once the core has been inserted, a zipper, hook-and-loop (Velcro), or other such construction on either side of the slit closes the opening and holds the core therewithin until it is desired to remove the core, upon which the slit is opened by the zipper and the core removed.

In a presently preferred embodiment of my invention, a building unit is in the general form of an elongated, substantially cylindrical log that has recesses at either end thereof. Those recesses are shaped to mate with similarly shaped recesses in another building unit, so that mounted in interlocking and/or superposed relationship, the log simulative units will be retained in their positions relative to each other. More preferably, these recesses are formed two to each end of a building unit and extend inwardly from the periphery of the log to a common, centrally disposed base that forms the floor of each recess. Further, in the presently conceived best mode of the invention, the cylindrical log is only generally cylindrical; opposed surfaces of the cylinder are flattened such that when the logs are mounted one atop the other, the opposed planar portions will meet and form contiguous surfaces the conjunction of which will provide a loose seal between adjoining logs that will be tighter than were the logs only to have a line contact with each other as if they were precisely cylindrical.

These and other objects, features and advantages of the present invention will become more readily apparent from the detailed description of a preferred embodiment of the invention, which description is presented in conjunction with the annexed drawings in which:

DETAILED DESCRIPTION OF A PREFERRED EMBODIMENT

Figure 1:
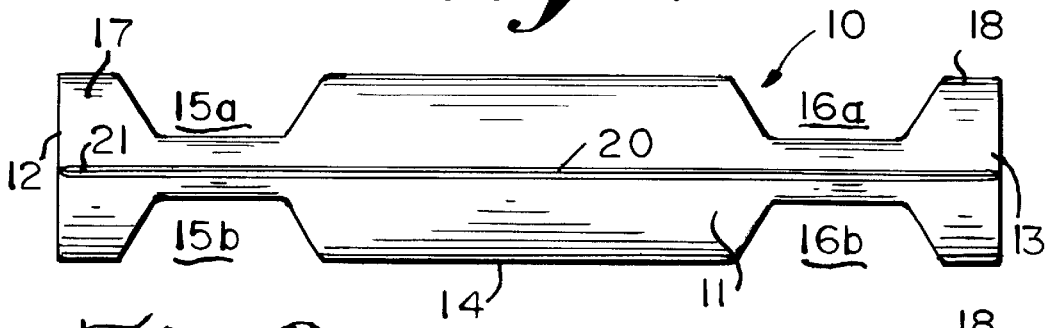
FIG. 1 is a side elevational view of a building unit according to my invention.
Figure 2:
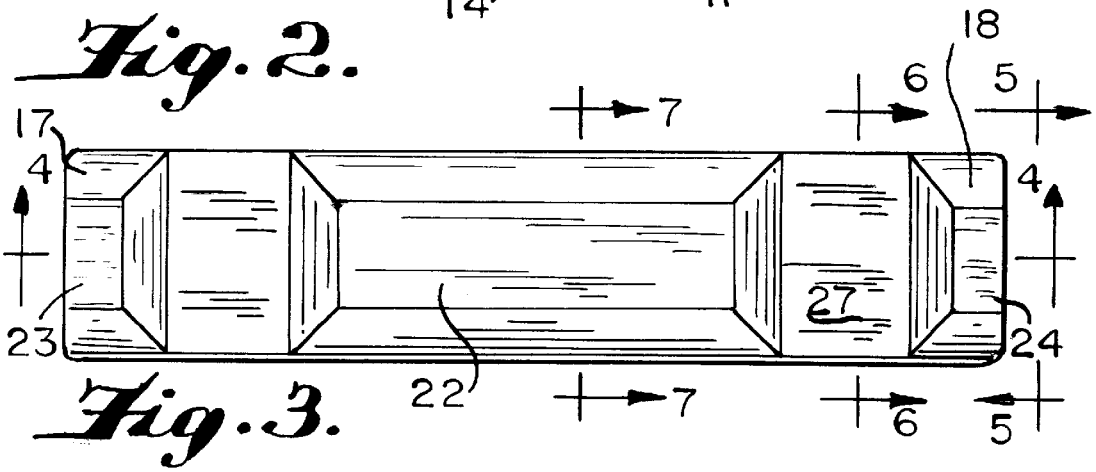
FIG. 2 is a top plan view of that unit.
Figure 3:
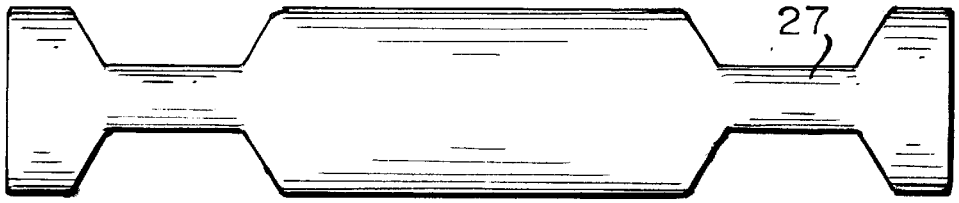
FIG. 3 is another side elevational view of the unit of FIG. 1, but viewing the unit from the other side thereof.

Referring now to the drawings, and more particularly, to FIGS. 1 to 3 thereof, a single embodiment that constitutes the best mode of the present invention is there illustrated. In that embodiment, the building unit is generally referenced by numeral 10. From its outside appearance, that building unit, as seen in FIG. 1, for example, includes a generally cylindrical body 11 which extends between opposed unit ends 12 and 13. As so seen, the building unit 10 includes a central portion 14 spaced by opposed recesses 15*a* and 15*b* at one side, and 16*a* and 16*b* at the other, from respective end portions 17 and 18. These same features are also apparent from the side elevation illustrated in FIG. 3.

However, in the side shown in FIG. 1 there is an elongated slit 20 that extends the length of the building unit 10 and through. end portion 17, central portion 14, and end portion 18 of the unit. That slit 20 is intended to provide ingress to the interior of the unit. The slit is opened or closed in a normal manner by zipper, hook-and-loop or other fastening method, the handle 21 of which is shown. The zipper illustrated generally, and the teeth of the zipper extend in a known manner at either side of slit 20.

FIG. 2 is a top plan view of the building unit of FIG. 1 and, along with FIG. 3, has been numbered in a similar manner as FIG. 1. What is seen in FIG. 2 is perhaps in somewhat different detail from that of FIGS. 1 and 3. While the log-like structure is intended to be generally cylindrical, it is not completely cylindrical in that there is a flattened, substantially planar surface 22 formed in the top wall of the central cylinder body 11. That generally planar surface also extends to top wall portions 23 and 24 of unit end portions 17 and 18, as shown. In this manner when another unit of a similar shape to that disclosed in FIG. 2 is placed atop that unit, the surfaces 22, 23 and 24 of that building unit will lie contiguous with those respective surfaces of the building unit illustrated in FIG. 2, and cause a better supported and more secure structure to be obtained, regardless of the presence or lack of any adhesive material used to secure the units to each other.

Figure 4:
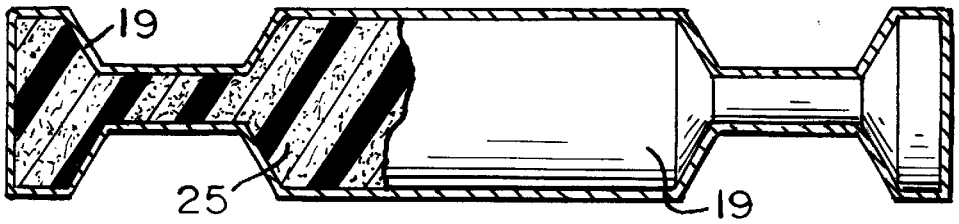
FIG. 4 is a partial, longitudinal sectional view of the unit taken in the direction of the arrows 4—4 of FIG. 2.

Referring now to FIGS. 4 to 7 of the drawings, it will be seen that a unit is composed of two general parts, an outer covering 19, and an inner core 25. That inner core is formed of one continuous piece and completely fills the interior of the covering 19. The covering is likewise formed from a single piece of fabric that entirely houses the core, which fills the interior of the covering so that, in its most preferred form, there are no gaps or air spaces between the covering and the core. In order to obtain such uniform filling of the covering, the core is normally manufactured as a separate unit, i.e., the core is pre-shaped prior to being placed within the slit 20 and thereafter being pressed within covering 19 until the core fully occupies the interior of the covering 19 as shown in FIG. 4.

Figure 5:
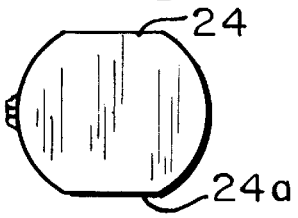
FIG. 5 is an end view of the unit, taken in the direction of the arrows 5—5 of FIG. 2.

With respect to transverse views 5, 6, and 7 of a building unit, in FIG. 5 an end view shows the shape of the unit, which is intended to be generally cylindrical except for, in a preferred form, flattened portions seen at top and bottom of the cylinder. In the end view of FIG. 5, the upper flattened portion of the cylinder end 13 is portion 24, and in line therewith and not separately seen are portions 22 and 23. A similar planar surface is formed in the lower surface of the covering and has been labelled in FIG. 5 by reference numeral 24*a*.

Figure 6:
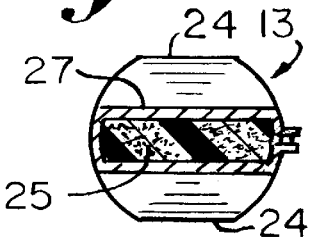
FIG. 6 is a transverse sectional view taken in the direction of the arrows 6—6 of FIG. 2.
Figure 7:
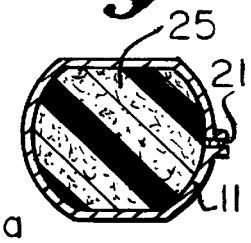
FIG. 7 is a transverse sectional view taken in the direction of the arrows 7—7 of FIG. 2.

With respect to FIG. 6, which is a sectional view taken in the direction of arrows 6—6 of FIG. 2, it will be apparent that what is seen are flattened portions 24 and 24*a* of unit end portion 13, as well as the relatively narrow portion of the unitary core 25 between recesses 16*a* and 16*b*. The floor of recess 16*a*, identified by reference numeral 27, is seen in FIGS. 2, 3 and 6. Then, in FIG. 7, the interior core 25 is well illustrated together with the covering 11 and zipper 21.

Figure 8:
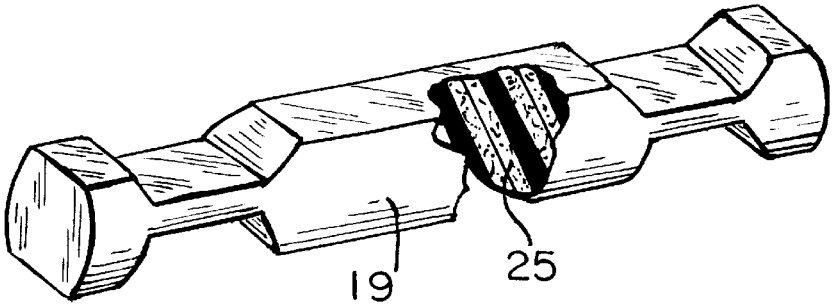
FIG. 8 is a perspective view, partly broken away, showing the structure of the building unit.

The same basic embodiment is also found in the perspective view of FIG. 8, with the various portions of the building unit being identified by the same reference numerals as have been used with respect to those portions in FIGS. 1 to 7 hereinbefore. FIG. 8 is partially broken away to reveal the interior core 25, which is encased within the similarly shaped covering 19.

Figure 9:
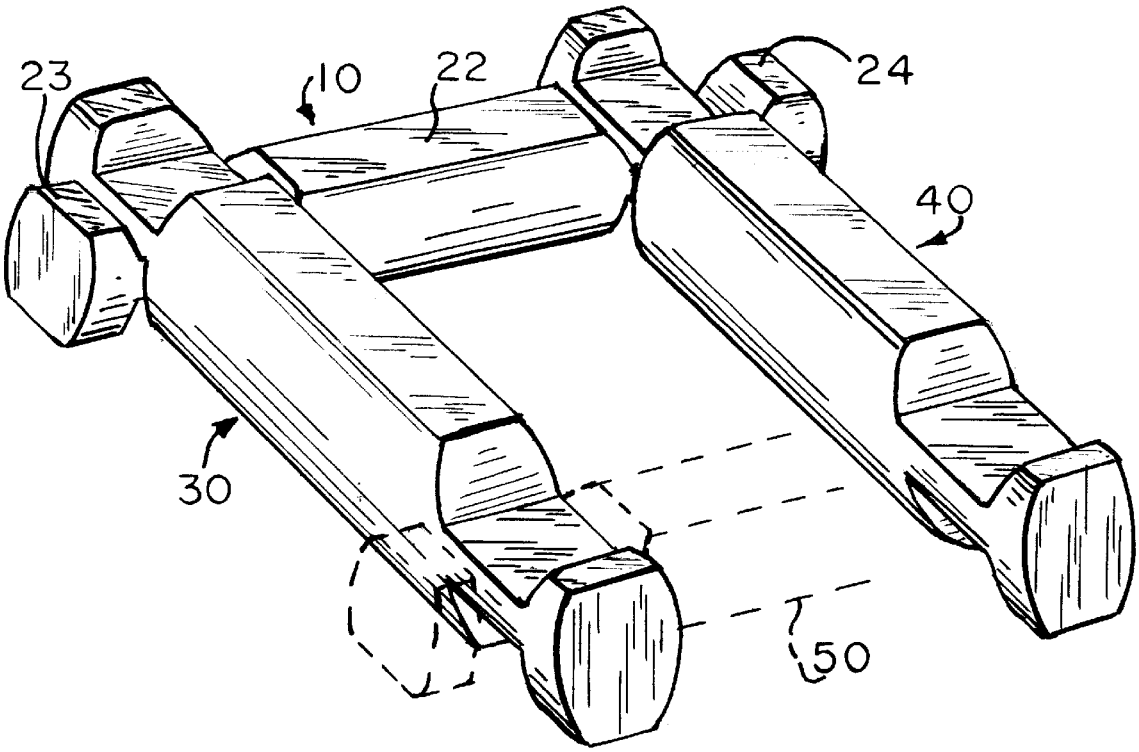
FIG. 9 is a perspective view showing partial assembly of several building units to form a structure according to my invention.

Finally, in FIG. 9, several building units have been arranged as they would if a structure is to be formed from them. In order to distinguish between the building units, they are generally labelled as units 10, 30 and 40, with a phantom unit being generally indicated by broken lines 50. As they are shown, building unit 10 is located such that its recess, which corresponds to recess 15*a* of the unit of FIGS. 1 to 8, has now been covered by unit 30, such that the corresponding recess 15*b* of unit 30 lies astride recess 15a of unit 10. In a similar manner, recess 16*a* of unit 10 is covered by unit 40's recess corresponding to recess 15*b* so labelled in FIG. 1 with respect to unit 10.

In this manner, with two recesses cooperating with each other, surface 22 of the central portion 11 of unit 10, together with surfaces 23 and 24 of end portions 17 and 18, respectively, of that unit, now form a more or less coextensive surface, the gap formed by recesses 15*a* and 16*a* having been bridged by the gaps of units 30 and 40 corresponding to gaps 15*b* and 16*b* of unit 10. In this manner the floors of the recesses of units 30 and 40 will lie in substantially the same plane as the planar surface of unit 10 formed by surfaces 23, 22, and 24.

The core of the unit is generally composed of a resilient material, and in a presently conceived best mode of the present invention, from a foam rubber that is, in itself, insufficient to provide a satisfactory building unit because it is subject to ready deformation and possible degradation if exposed to normal hazards of daily use. However, a broad range of resilient materials, both formed from natural rubber or of synthetic foams, e.g., polyurethane foams, may be utilized. The outer covering is formed from fabric which, when filled with the preformed foam, will thereafter have sufficient rigidity to form building unit. Most preferably, it is conceived that the outer covering will be made of a vinyl polymer, although it can be made of natural or other synthetic fabrics as well. The advantage of a vinyl polymer is that, upon being subjected to normal wear, and particularly normal wear by a child, the vinyl can be more easily cleaned than many natural materials, e.g., cotton, wool, and the like. However, the outer covering 11 can be formed from a wide variety of materials and still be part of a satisfactory building unit, and this wide variety of materials is intended to be included within the term, fabric, as used herein.

As stated, the present invention is believed to be particularly adapted to be used as a toy by children who, having graduated from a wooden, miniature log set, may desire to build a playhouse of such dimensions that the child can occupy the house on a temporary basis. When the child desires to employ the building units to construct a different type of structure, the playhouse may be disassembled, indeed, demolished, without any harm to any children in close proximity to, or even occupying the interior of the playhouse, because the materials from which the building units are constructed are so light-weight and resilient.

However, it is considered to be within the broad scope of the present invention that these building units also can be put to a more permanent use, for example, by erecting a construction during which the floors of recesses of mating notches will be sealed together, for example, by cement or adhesive, so that a more or less permanent structure will be formed. While any such structure will not have the degree of permanency, for example, of wood or brick, it should be suitable for erecting a structure to be used for a fairly short period of time, for example, at a display or convention. Thus, while perhaps at this time the primary use of the present invention will be as a toy for children, its uses are certainly not limited to any such plaything.

One feature of the present invention is considered to be the size of the log-imitative building unit. Thus, rather than being the size of prior art units, i.e., miniature, in its most preferred embodiment the present building unit is approximately 47 inches in length, and the cylinder that comprises its overall dimensions has a diameter of 7 inches. However, units 2 feet long and greater are contemplated. Utilizing a building unit of this size enables a child to build a playhouse, for example, of an overall size that will accommodate a small child in its interior without the necessity of assembling an undue multiplicity of individual units.

It will be apparent to those of skill in the art that many modifications and alterations can be made in the preferred embodiment of the present invention shown and described herein without the use of any inventive skill. As to all such modifications and alterations that would be obvious to one of ordinary skill in this art, it is desired that they be included within the purview of my invention, which is to be limited only by the scope, including equivalents, of the following, appended claims.

I claim:

1. A building unit from a plurality of which a play structure is formed, comprising a pre-shaped, one-piece core formed from a lightweight, resilient foam subject to ready deformation, said core being in the shape of a generally cylindrical log having opposed planar portions formed in its periphery and opposed recesses formed in each end thereof, said recesses being shaped to mate with similarly shaped recesses formed in other, similarly shaped logs, and an outer covering for said core, said covering being formed from a fabric having the same shape as said core and encasing it snugly without substantial gaps or air spaces, said covering having formed therein a means for permitting the removable insertion of said pre-shaped core within said covering, and further formed therein a means for removably retaining said core within said covering after said core has been located therewith, said unit being at least about 2 feet in length and having sufficient structural integrity that it is useful as a unit from said plurality of which a play structure is formed of at least a size that will accommodate a small child in its interior and which structure, upon demolition, will cause only minimal or no discomfort to an individual in close associated therewith.

2. A building unit as claimed in claim 1, in which said covering is formed from a synthetic, plastic material.

3. A building unit as claimed in claim 1, in which said covering is formed from a vinyl polymer.

4. A building unit as claimed in claim 1, in which said insertion means includes a slit extending along a majority of the length of said covering, and said retaining means is a zipper for opening and closing said slit.

* * * * *